US009031254B2

(12) United States Patent
Heise

(10) Patent No.: US 9,031,254 B2
(45) Date of Patent: May 12, 2015

(54) INDUCTIVE EARPHONE COUPLING

(75) Inventor: Stefan Heise, Bronshoj (DK)

(73) Assignee: GN Netcom A/S (DK)

( * ) Notice: Subject to any disclaimer, the term of this patent is extended or adjusted under 35 U.S.C. 154(b) by 203 days.

(21) Appl. No.: 13/527,802

(22) Filed: Jun. 20, 2012

(65) Prior Publication Data

US 2012/0328119 A1 Dec. 27, 2012

(30) Foreign Application Priority Data

Jun. 23, 2011 (EP) ..... 11171124

(51) Int. Cl.
*H04R 1/10* (2006.01)
*H04R 5/033* (2006.01)

(52) U.S. Cl.
CPC ..... *H04R 1/1066* (2013.01); *H04R 5/0335* (2013.01); *H04R 2420/07* (2013.01)

(58) Field of Classification Search
CPC .. H04B 5/0031; H04B 5/0037; H04B 5/0081; H04B 5/02; H04B 1/086; H04W 4/008; H04R 1/1041; H04R 1/02; H04R 17/00; H04R 2499/11; H04R 25/50; H04R 2201/109; H04R 25/70; H04R 3/00; G06F 1/1698; G06F 3/165; H04L 2012/2841; H04M 1/03; H04M 1/6041; H04M 1/035; H04M 1/06; H04M 1/6058
USPC ..... 381/74, 317, 318, 322, 323, 327, 328, 381/331, 334, 91, 122, 166, 370, 376, 377, 381/378, 379, 185, 401, 406, 371, 374, 381, 381/383, 384, 386, 387, 390, 394, 395, 189, 381/190, 196, 400, 409, 411; 455/569.1, 455/575.2, 41.1; 379/55.1, 443
See application file for complete search history.

(56) References Cited

U.S. PATENT DOCUMENTS

| | | | | |
|---|---|---|---|---|
| 6,466,681 | B1 * | 10/2002 | Siska et al. | 381/372 |
| 2007/0149261 | A1 | 6/2007 | Huddart | |
| 2009/0041285 | A1 | 2/2009 | Parkins et al. | |
| 2010/0290657 | A1 * | 11/2010 | Wiggins et al. | 381/328 |

FOREIGN PATENT DOCUMENTS

| | | |
|---|---|---|
| CN | 1232362 | 10/1999 |
| CN | 201063828 | 5/2008 |
| EP | 0936841 | 8/1999 |
| EP | 2178275 | 4/2010 |
| GB | 2160075 | 12/1985 |
| GB | 2476033 | 6/2011 |

OTHER PUBLICATIONS

Office Action and English translation for Chinese patent application No. 2012102140159 issued on May 27, 2014.

* cited by examiner

*Primary Examiner* — Leshui Zhang
(74) *Attorney, Agent, or Firm* — Altera Law Group, LLC

(57) ABSTRACT

A headphone or a headset having at least a first and a second earphone unit is provided, the first and second earphone units being interconnected via a connecting band, the connecting band having a first end configured to connect to the first earphone unit and a second end configured to connect to the second earphone unit, wherein at least the first earphone unit comprises a first transceiver, and at least the first end of the connecting band comprises a second transceiver, the first and second transceivers being configured to inductively connect, thereby connecting the first earphone unit to conducting elements in the connecting band. It is an advantage of using an inductive connection between the earphone unit and the connecting band that no wires need to be transferred from the earphone unit to the connecting band. Hereby, a 360 degree rotation of the joint may be obtained.

10 Claims, 3 Drawing Sheets

INDUCTIVE EARPHONE COUPLING

FIELD OF INVENTION

The present invention relates to headphones and/or headsets for audio transmission, such as for voice communication, and in particular to headphones and/or headsets with two earphones such as duo or stereo headphones and/or headsets.

BACKGROUND OF THE INVENTION

It is well known to provide headphones and headsets for audio communication, the headsets typically having one or two earphones and a microphone, such as a microphone mounted on a boom or a mouthpiece. For headphones and headsets having two earphones, the earphones are typically connected via headbands, neckbands or other suitable means. To provide audio from one earphone housing to the other, an electrical connection connects the two earphones and typically a wired connection connects the two earphones through the headband. The headsets may furthermore be wired or wireless, where the wireless headsets include a wireless communication hub, whereas the wired headsets connect signals from the headset to a telephone system and vice verse by wire. Typically, the wired connections are provided via one or more joints.

In order to protect the wires passing through the joint from damage due to twisting, arising from rotation to the joints, typically these joints are fixed joint, i.e. non-rotatable joints, making it cumbersome for a user to adjust the headset to a most favourable position. Furthermore, when putting the headset down and picking it up numerous times a day, any wires may get tangled. Alternatively, the joints may be partly rotational and include a mechanical stop to restrict rotation. Such a mechanical stop then acts to limit the travel of the joint to less than a full revolution or to less than 360 degrees. However, failure of the mechanical stop is a common cause for malfunction of the headsets as such stops may simply break off, and the joints are complex to manufacture and add costs to the headset. Furthermore, a joint having a mechanical stop makes it more cumbersome for a headset user to adjust the headphones and headsets, and especially duo headphones and headsets.

It is known in the art to provide a rotatable microphone boom, such as to allow a user to e.g. switch from one ear to another and move the microphone boom to the desired position. Such headsets may have a microphone boom with a mechanical stop to restrict the movement of the microphone boom, however also microphone booms without a mechanical stop, such as disclosed in EP 2 178 275, where the microphone boom is fully rotatable are known in the art.

However, using a rotatable microphone boom is not always advantageously. Typically, the boom is delicate and the rotatable connection can be complex, thereby adding to the costs of the products. Thus, for headsets, especially such as for cost sensitive consumer headsets, other ways of optimizing the ergonomics and user friendliness of the headsets must be found. Thus, a way for optimizing the ergonomics and user friendliness of the headsets and headphones must be found.

SUMMARY OF THE INVENTION

It is therefore an object of the present invention to provide a headphone and/or a headset overcoming one or more of the disadvantages of the prior art.

According to the invention, a headphone having at least a first and a second earphone unit is provided, the first and second earphone units are interconnected via a connecting band. The connecting band has a first end configured to connect to the first earphone unit and a second end configured to connect to the second earphone unit. At least the first earphone unit comprises a first transceiver, and at least the first end of the connecting band comprises a second transceiver, where the first and second transceivers are configured to inductively connect, thereby connecting the first earphone unit to conducting elements in the connecting band.

In an exemplary embodiment, also the second earphone unit and the second end of the connecting band comprises a transceiver, the transceivers being configured to connect the second earphone unit to conducting elements in the connecting band.

It is an advantage of using an inductive connection between the earphone unit and the connecting band that no wires need to be transferred from the earphone unit to the connecting band. Hereby, a 360 degree rotation of the joint may be obtained. It is an advantage of the headphone according to the invention that the connection to the connecting band is rotatable around an axis with no restrictions or build-in stops.

Having a fully rotational joint may provide the advantage for the user of being able to easily optimize the ergonomics of the headphone and/or headset and thereby providing a user-friendly and easily adjustable headphone and/or headset.

This is especially advantageously when at least one of the first and second earphone units further comprises a microphone unit, such as a pickup unit which may comprise or consist of a microphone boom.

One or more of the first, second and any additional earphone units preferably comprises at least a speaker and/or electronics, such as an electronic or electrical circuit for processing audio signals. The electronics may comprise amplification elements, noise reduction elements, etc.

The conducting elements in the connecting band may be any electrically conducting elements, and may comprise wires, flex foil or any other conducting means suitable for being positioned in the connecting band.

The connecting band may be a headband, a neckband or any other connecting means.

In a preferred embodiment, the connecting band may be detachably connected to at least one of the first and second earphone units. Hereby, a user may switch between different types of connecting bands according to the situation and/or between preferred wearing styles for different situations. Thus, the earphone units and the connecting bands may be provided separately, and a number of connecting bands styles may be provided.

Furthermore, by providing detachable earphone units, a user may also switch between mono and duo headphones for different situations, such that a mono headphone or headset is used for e.g. shorter conversations, whereas a duo or stereo headphone or headset is used for longer conversations or for listening to music. Also, an earphone unit comprising a microphone and an earphone unit without a microphone may be interchangeable so as to enable changing between headphone and headset use.

The first end of the connecting band may preferably be formed as an earphone unit connector part. The earphone unit connector part may be configured to connect to the earphone unit. Preferably, the earphone unit has a corresponding connector part to receive the earphone unit connector part.

The first earphone unit and the first end of the connecting band are preferably mutually rotatable around a first rotational axis, and by providing the first and second inductive transceivers substantially symmetrically about the same rotational axis, a low loss inductive connection may be provided.

The first and second transceivers may comprise a first and a second inductive coil, respectively, having a common core, such as an iron core, such as any core having suitable magnetical properties.

In a preferred embodiment, the headphone and/or the headset has at least a first earphone unit that is rotatable about a first rotational axis. The first earphone unit and/or any further earphone units may comprise an earphone unit circuit, a first speaker for receiving a speaker signal from the earphone unit circuit, and at least the first transceiver configured to be in electrical contact with the earphone unit circuit. The headphone may further comprise an earphone unit connector part which may comprise at least the second transceiver. Preferably, the first and second transceivers are being configured to be inductively connected to thereby transfer speaker signals from the first earphone unit to the conducting elements in the connecting band and/or to the earphone unit connecting part.

The first transceiver may comprise a first or a primary coil for inducing a current to a second or secondary coil in the second transceiver in any conventional way. The first and second coils may be positioned in the earphone unit and the earphone unit connector part in any way.

The transceivers may be rotatably mounted or the transceivers may be positioned at a rotatable part of the earphone unit and/or the earphone unit connector part.

In a preferred embodiment, the first coil is provided annularly around the first rotational axis and furthermore, also the second coil may be provided annularly around the first rotational axis.

In the earphone unit, the first coil may be provided annularly around the first speaker, the centre axis of the first speaker may thus be the first rotational axis.

Preferably, the earphone unit connector part comprises a ring shaped part for attachment to the earphone unit, wherein the ring shaped part comprises the second/secondary coil. The earphone unit connector part may be configured to be connected to the earphone unit so as to allow for an inductive connection between the earphone unit and the earphone unit connector part.

In an especially preferred embodiment, the earphone unit connector part is detachably mounted to the earphone unit to thereby render the earphone unit detachably.

In a further embodiment, a headphone set may have a primary earphone unit and a secondary earphone unit, the primary earphone unit and the secondary earphone unit being interconnected via a connecting band, wherein the interconnecting band is detachably connected to at least the primary headphone unit and the signal transfer from at least the primary headphone unit to the connecting band is configured to be performed inductively.

Furthermore, an inductive coupling may be provided for connecting the at least first and/or any further earphone units with e.g. a second speaker, and/or a hard-wired line entering/exiting the headphone or headset. The hard-wired line may connect to an electronic circuit for processing signals from the at least one microphone, a base unit, such as a base unit for a voice communication system, such as a telephone system, an external speaker, an external microphone, a headset amplifier, a USB controller, etc. and/or any combination of these.

The headphone may be of a type typically connecting a user to an audio system, such as an audio/speaker system, for example a computer telephone system, such as a soft phone system, such as an IP phone system, a wireless phone system, such as a cellular phone system, or a landline based phone system, etc., for example to a music system, such as an audio player, such as an mp3 player, such as a computer based audio system, for example to a game console, such as an Xbox, a Wii, etc., such as to a musical instrument, etc. The headphone or headset according to the present invention may connect to the audio system via any base unit, such as a base unit for e.g. a cordless system, a headset amplifier for e.g. a corded headset, a base amplifier, or an amplifier unit, etc., or the headset may connect directly to the audio system.

For a headphone or headset, the size of any component matters, and, especially for providing connections in a direction normal to the first rotational axis of the earphone unit, space is limited.

The earphone unit connector part may form part of the earphone unit, and the earphone unit may comprise the earphone unit connector part. Thus, for a user of a headphone or headset, the earphone housing connector part may not be immediately recognizable as a connector part.

For a headset having at least one microphone, the electronic circuit for processing signals from the at least one microphone may be positioned in the earphone unit and the microphone may connect to the electronic circuit in any known way. However, in some headsets, it is advantageously to provide the electronic circuit outside of the earphone unit. Thus, in some embodiments, the base unit may comprise the electronic circuit for processing signals from the at least one microphone. The advantage of providing the electronic circuit for processing signals from the at least one microphone in the base unit is that only a simple earphone unit circuit needs to be arranged within the earphone unit, thereby reducing the overall weight of the headset.

The earphone unit circuit may, thus, be a passive electrical circuit, directing signals from one part of the earphone unit to another, or the earphone unit circuit may include one or more functionalities. The earphone unit circuit may furthermore include passive and active components, and still further, the earphone unit circuit may comprise the electronic circuit for processing signals from the at least one microphone. Furthermore, the earphone housing circuit may comprise electronics for establishing wireless or cordless communication with the voice communication system, via any known standard such as via DECT, Bluetooth, etc.

In a preferred embodiment, the earphone unit circuit is provided on one side of a printed circuit board, and the at least first coil is provided on another side of the printed circuit board, wherein the connections are made e.g. via through-holes in the printed circuit board. It is an advantage of providing the first coil directly on the printed circuit board that the design may be particular compact. Furthermore, by providing the annular coil(s) directly on the printed circuit board, fewer parts need to be assembled. In one embodiment, the earphone unit circuit include the electronic circuit for signal processing signals from the at least first microphone, and the at least first coil, whereby the number of parts needed to be assembled during manufacturing is further reduced.

It is an advantage of using an inductive connection that no electrical connectors, such as contacts which may change over time due to e.g. oxidization in the surfaces of any contact members are used in the inductive connection. Thereby any detrimental effect on the sound quality of the audio signal transmitted over the connection stemming from those changes is avoided.

The pickup unit may comprise or consist of a microphone boom.

The present invention will now be described more fully hereinafter with reference to the accompanying drawings, in which exemplary embodiments of the invention are shown. The invention may, however, be embodied in different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout. Like elements will, thus, not be described in detail with respect to the description of each figure.

DETAILED DESCRIPTION OF THE FIGURES

Figure 1:
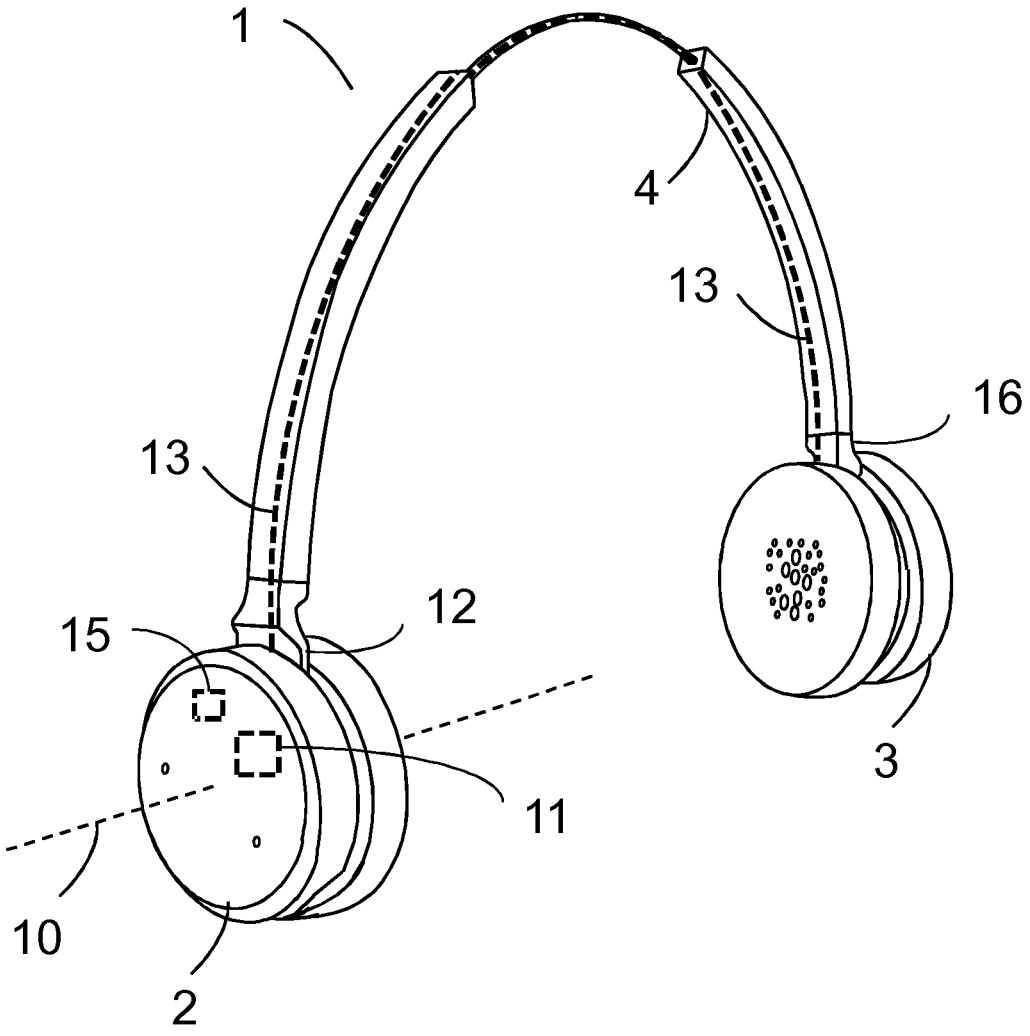
FIG. 1 shows a wireless headphone with two earphone units.

FIG. 1 shows a headphone 1 according to the present invention. The headphone 1 has a first and a second earphone unit 2, 3, and a connecting band 4; in the present case a headband is shown but it is envisaged that also other wearing styles may be used, for example such as neck bands. A first end 12 of the connecting band 4 connects to the first earphone unit 2, and a second end 16 of the connecting band 4 connects to the second earphone unit 3.

The earphone unit 2 is rotatable about a first rotational axis 10 indicated by a dashed line in the figure, so that the earphone unit 2 may be rotated when arranging and adjusting the headphone 1. The earphone unit comprises a speaker in a housing (not shown in FIG. 1) and an earphone unit circuit shown schematically as 11. It is an advantage of the present invention that the earphone unit 2 is connected to the connecting band 4 via earphone unit connector part 12 shown in detail in FIG. 3, which is freely rotatable with respect to the earphone unit. In this way, the earphone unit 2 is freely rotatable and allows the user to adjust the headphone in any way convenient for the user without being restricted by mechanical stops or fixed joints, etc. A headphone having two earphones requires an electrical connection from the first earphone unit 2 to the second earphone unit 3. Typically, this is achieved by pulling a wire from the earphone unit circuit 11 in earphone unit 2, through a connecting band to the second earphone unit 3. By using the earphone unit connector part 12 configured to establish an inductive coupling to the earphone unit, it is achieved that the earphone unit and the headband 4 connecting to the second earphone unit 3 are mutually rotatable to 360 degrees without restrictions. Wire(s) 13 are provided in the connecting band 4 for connecting the first earphone unit 2 with the second earphone unit 3. The wires 13 are connected to the earphone unit connector part 12 which inductively connects to the earphone unit 2 (see FIG. 3).

The earphone unit 2 may further comprise a microphone positioned within the earphone unit to be able to use the headphone 1 as a headset.

The earphone unit connector part 12 and/or 16 may be detachable or releasably fixed to the earphone unit, for example via a spring loaded fitting, a press fitting, a magnetic fixation or any corresponding means as known to the person skilled in the art.

Figure 2:
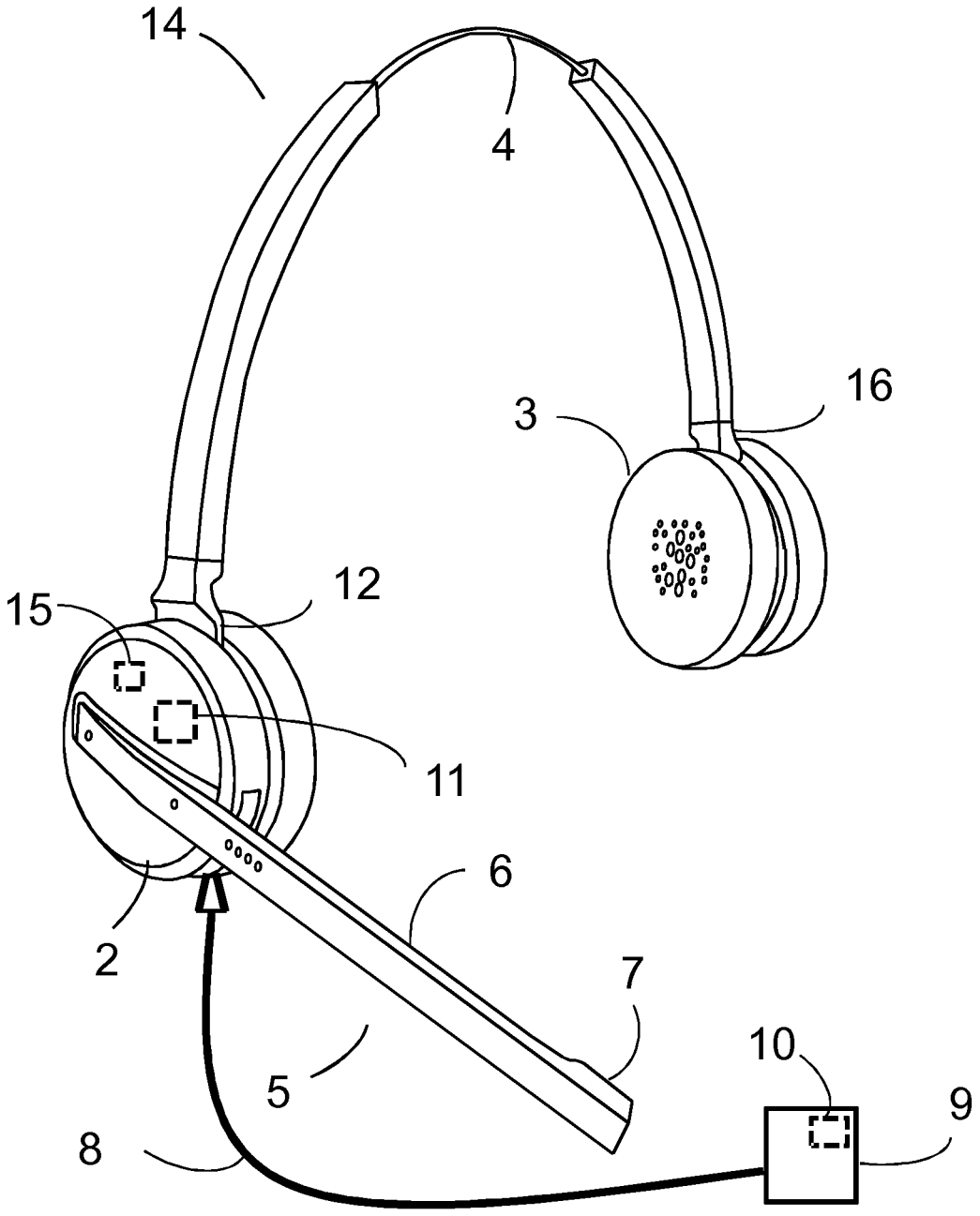
FIG. 2 shows a wired headset with two earphone units and a pick-up unit.

In FIG. 2, another headset 14 according to the present invention is shown. The headset 14 is a wired headset having a first and a second earphone unit, 2, 3, a headband 4, and a pickup unit 5 having a microphone boom 6 with a microphone 7 arranged on the earphone unit 2. The headset 14 is of a wired type, and a wired connection 8 connects the headset 14 to an external telephone system, such as a soft phone system via base unit 9. It is envisaged that the base unit 9 may be dispensed with so that the headset 14 connects directly to a voice communication system such as to a computer, a network, or a standard telephone. In FIG. 2, the base unit 9 comprises the electronic circuit 10 for processing signals from the at least one microphone 7 and is connected to the microphone/earphone unit 2 through the wired connection 8. It is envisaged that the present invention also encompasses an embodiment wherein the electronic circuit 10 for processing signals is comprised within the earphone unit 2 so that the wired connection connects the processed microphone signal to a voice communication system.

The earphone unit 2 is rotatable about a first rotational axis 10 indicated by a dashed line in FIG. 1, so that the earphone unit 2 with the pickup unit 5 may be rotated when arranging and adjusting the headset 14 and e.g. move the pickup unit 5 from one side of the head to another. In this way, the pickup unit 5 arranged on the earphone unit 2, is freely rotatable with the earphone unit, thus allowing the user to adjust the headset 14 in any way convenient for the user without being restricted by a wired fixed joint between the earphone unit 2 having a microphone boom 6 and the headband 4. The wire(s) 13 as shown in FIG. 1 are also provided in the connecting band 4 for connecting the first earphone unit 2 with the second earphone unit 3 in the headset 14 as shown in FIG. 2, but the wires are not shown specifically.

It is an advantage of connecting the two earphone units via a connecting band that the connecting band ensures the positioning of the earphone units relative to another, which means that the balancing of the earphone units may be maintained substantially constant.

The earphone unit connector part 12 may form part of the earphone housing 2. The headband 3 has an electrical connection to the earphone unit which is established via an inductive coupling. The earphone unit may therefore in any conventional way be freely rotatable with respect to the connecting band.

Alternatively or additionally to the connecting wire 8, the earphone unit 2 may further comprise a wireless or cordless communication device 15, such as a cordless communication device communicating with the external voice communication system via DECT, Bluetooth, etc. In some embodiments, the wired connection 8 may then be dispensed with.

Figure 3:
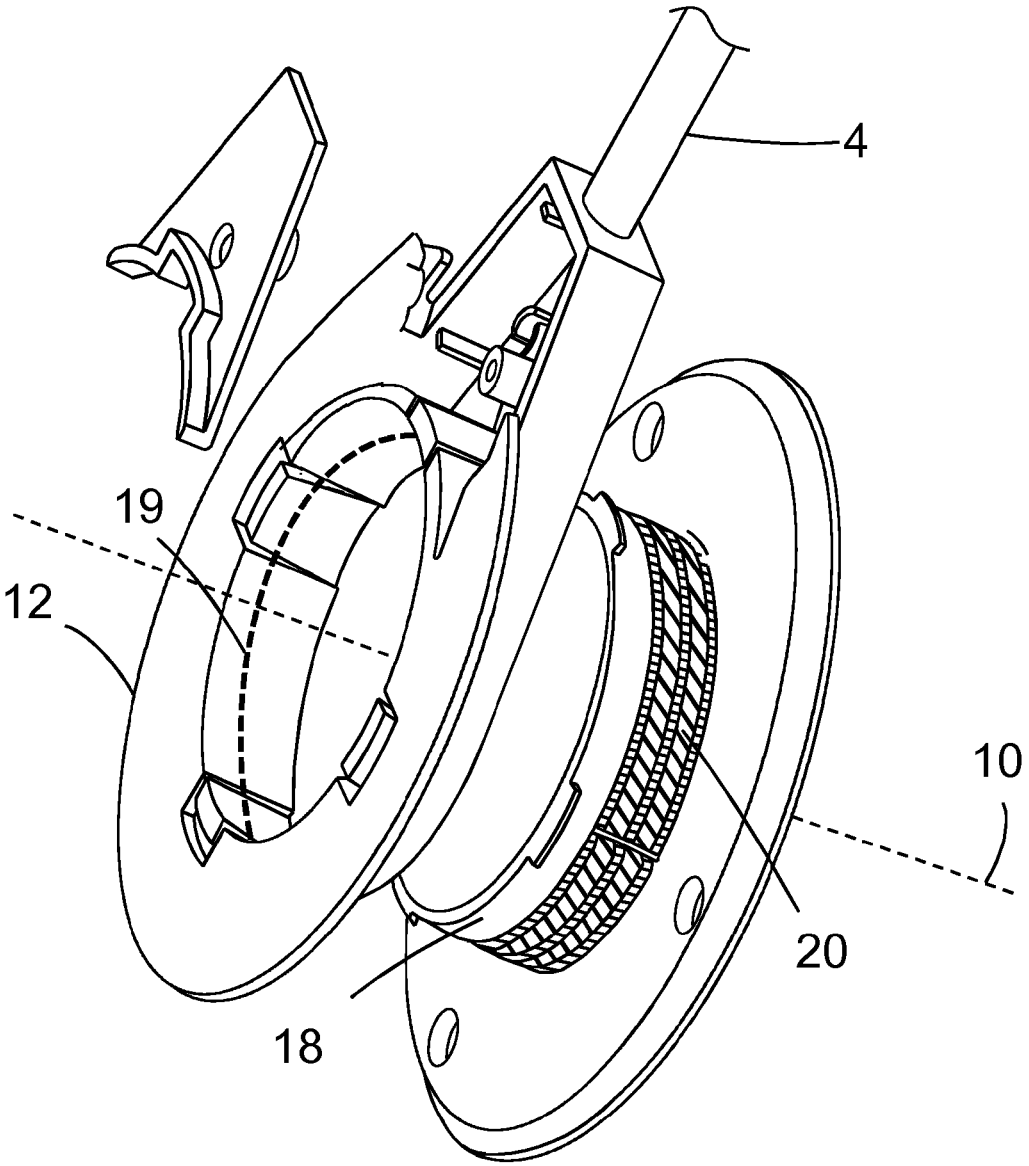
FIG. 3 shows an exploded view of an embodiment of an earphone unit according to the present invention.

FIG. 3 shows the earphone unit 2, and the earphone unit connector part 12 in more detail. The earphone unit 2 comprises a speaker having a speaker housing 18 and the earphone unit connector part 12 is formed so as to attach annularly around the speaker housing 18. Wires 13 provided in the connecting band are connected to a second coil 19 provided annularly along an inner (or outer) surface of the earphone unit connector part 12. Alternatively and preferably, the second coil is provided within the earphone unit connector part, such as moulded in the earphone unit connecting part, such as moulded in the plastic forming the earphone unit connecting part. In the earphone unit 2, a corresponding first coil 20 is provided annularly around an outer (or inner) surface of the speaker housing 18. The first and second coil 19, 20 may have one or more turns, and preferably, the first and second coils may have a common core. The first coil 20 may form a primary winding, and the second coil may form a secondary winding, the primary and secondary winding preferably being configured to establish an inductive connection.

In a preferred embodiment, the first coil is positioned along an outside of the speaker housing, the second coil is provided annularly within the earphone unit connector part 12 with the speaker housing forming a common core for the first and second coils 19, 20. The first and second coils are being provided with insulation (not shown) as required. Alternatively, the speaker provides the common core for the first and second coils 19, 20.

It is envisaged that even though the invention has been described with respect to earphone unit 2, the earphone unit 3 may comprise the same elements and may be connected to the second end 16 of the connecting band 4 via an inductive connection as described with respect to earphone unit 2.

Preferably, the magnetic fields from the first and second coil, respectively are coaxially provided to thereby render the transfer characteristic substantially independent of the position, such as substantially independent of the position of one coil with respect to the other coil when the coils are moved annularly around a coaxial centre axis.

It is a further advantage of providing an inductive coupling between the earphone unit and the connecting band that no wires extend from the earphone unit to the connecting band, thus making it much easier for a user changing e.g. a battery in the earphone unit in that no delicate wires are provided around or in close proximity to the battery.

The invention claimed is:

1. A headphone with a microphone configured for full rotatability of said microphone; comprising:

a earphone unit;

a headband having a connecting band portion the earphone unit being connected to said headband via the connecting band portion, said earphone unit being rotatable with respect to said connecting band portion, said connecting band portion and earphone unit being detachably and annularly joined to each other and coaxially aligned along a common axis, such that the earphone unit and the connecting band portion are mutually and freely rotatably with respect to the each other through 360 degrees of rotational freedom around said common axis without a mechanical restriction, said earphone unit and connecting band portion being inductively connected for a transmission of audio signals therebetween, said connecting band portion having a first coil concentric with said common axis and said earphone unit having a second coil concentric with said common axis and proximate to said first coil, said earphone unit having a speaker housing, said speaker housing being concentric with said common axis and providing a common rotational core for said connecting band portion and earphone unit around said common axis.

2. The headphone according to claim 1, wherein the connecting band is detachably and annularly connected to the earphone unit.

3. A headphone with a microphone configured for full rotatability of said microphone; comprising:

an earphone unit;

a headband having a connecting band portion, the earphone unit being rotatably connected to said headband via a connecting band portion, said earphone unit being rotatable with respect to said connecting band portion, said earphone unit and connecting band portion being detachably joined to each other and coaxially and annularly aligned along a common axis, such that the earphone unit and connecting band portion are freely rotatably with respect each other through 360 degrees of rotational freedom around said common axis without a mechanical restriction, said earphone unit and said connecting band portion being inductively connected for the transmission of audio signals therebetween, said earphone unit having a first coil concentric with said common axis and said connecting band portion having a second coil concentric with said common axis and proximate to said first coil said earphone unit having a speaker housing, said speaker housing being concentric with said common axis and providing a common rotational core for said connecting band portion and said earphone unit around said common axis.

4. The headphone of claim 3 wherein said earphone unit and connecting band portion have axially aligned apertures and wherein said speaker housing is sized to be received within said axially aligned apertures to provide a rotational hub for said speaker housing.

5. The headphone of claim 4 wherein said speaker housing include flanges and where said connecting band portion includes clips to engage said flanges, so that when said flanges engage said clips, said earphone unit and said connecting band portion are rotatably joined.

6. The headphone according to claim 4, wherein said first and second coils are located adjacent said axially aligned apertures.

7. The headphone of claim 3 wherein said first and second coils are inductively coupled so that signals from said microphone and to said speaker housing can be inductively transmitted.

8. The headphone according to claim 3 wherein said microphone extends from said connecting band portion.

9. The headphone according to claim 8 wherein said microphone includes a boom extension which is rotatable 360 degrees around said common axis without mechanical restrictions.

10. A headphone set comprising a primary earphone unit having a speaker and microphone; and a secondary earphone unit having at least a speaker, said primary earphone unit and said secondary earphone unit being interconnected via a connecting band, wherein the connecting band is detachably connected to at least the primary earphone unit and signal transfer from at least the primary earphone unit to the connecting band is configured to be performed inductively, and wherein each of said primary and secondary earphone units having a first and second members rotatable with respect to each other and being detachably and annularly joined to each other and coaxially aligned along a common axis, such that said first and second members are freely rotatably with respect to each other through 360 degrees of rotational freedom without a mechanical restriction, said first and second members being inductively connected for the transmission of audio signals therebetween, said first member having a first coil concentric with said common axis and said second member having a second coil concentric with said common axis and proximate to said first coil, said at least one earphone unit of the primary and secondary earphone units, having a speaker housing in one of said first and second members, said speaker housing being concentric with said common axis and providing a common rotational core for said first and second members around said common axis.

* * * * *